United States Patent [19]

Diller

[11] Patent Number: 4,765,496

[45] Date of Patent: Aug. 23, 1988

[54] CLAW COUPLING FOR TOY AND MODEL TRAINS

[75] Inventor: Hans Diller, Heroldsberg, Fed. Rep. of Germany

[73] Assignee: Gebr. Fleischmann, Nuremberg, Fed. Rep. of Germany

[21] Appl. No.: 4,468

[22] Filed: Jan. 20, 1987

[30] Foreign Application Priority Data

Jan. 23, 1986 [DE] Fed. Rep. of Germany ..... 3601951

[51] Int. Cl.[4] ..... B61G 1/00

[52] U.S. Cl. ..... 213/75 TC; 213/89; 213/90

[58] Field of Search ..... 213/75 TC, 75 R, 88, 213/89, 90, 150, 172, 173, 211; 104/DIG. 1; 105/1.5

[56] References Cited

U.S. PATENT DOCUMENTS

| | | | |
|---|---|---|---|
| 455,141 | 6/1891 | Woodworth | 213/90 |
| 574,741 | 1/1897 | Lipps | 213/89 |
| 766,805 | 8/1904 | Briegleb | 213/90 |
| 3,518,790 | 7/1970 | Zamarra | 213/75 TC |
| 3,564,766 | 2/1971 | Edwards et al. | 213/75 TC |
| 3,662,489 | 5/1972 | Terrier | 213/75 TC |

FOREIGN PATENT DOCUMENTS

| | | | |
|---|---|---|---|
| 4468 | of 1904 | United Kingdom | 213/88 |

*Primary Examiner*—Joseph F. Peters, Jr.
*Assistant Examiner*—Thomas J. Brahan
*Attorney, Agent, or Firm*—Jordan and Hamburg

[57] ABSTRACT

Claw coupling for electric toy and model trains, with a pre-uncoupling device with a claw, which can be swivelled in a horizontal plane and hooked from the side into a rigid hook of the respective opposite anchoring bracket, with a support pin resting in a borehole, which can be lifted out of its coupling position against the force of gravity in an upwards direction into an uncoupling position by a coupling cam of an uncoupling rail, which engages a downwards projecting uncoupling bolt, the support borehole and the support pin each being disposed at the outer edge of the mounting bracket or the claw and the mounting bracket having an approach mandrel for the inner arm of the claw of the respective opposite mounting bracket.

15 Claims, 2 Drawing Sheets

CLAW COUPLING FOR TOY AND MODEL TRAINS

The invention relates to a claw coupling, especially for electric toy and model trains, with a pre-uncoupling device with a claw, which can be swivelled in a horizontal plane and hooked from the side into a rigid hook of the respective opposite anchoring bracket, with a support pin resting in a borehole, which can be lifted out of its coupling position against the force of gravity in an upwards direction into an decoupling position by a coupling cam of an uncoupling rail, which engages a downwards projecting uncoupling bolt.

Such a claw coupling, which has become known as a so-called Fox coupling and is described in the German Offenlegungsschrift No. 2,041,361, makes possible the construction of short couplings which, aside from coupling and uncoupling, at the same time make a pre-uncoupling by the uncoupling rail possible in such a manner, that the carriages with raised claws can be pushed to any site of the track system and sidetracked there and that recoupling is possible only after the vehicles, from which these carriages have been separated for the present, have "taken off".

The difficulties with the Fox coupling heads consist therein that the claw must be braced by a swivelling restoring spring, which is constructed as a torsion spring, which surrounds the supporting pin and is supported at a thickened head at its underside and which, at the same time, generates the vertical restoring force. The manufacture of the parts and especially the assembly of the very small components, especially of the helical spring, created considerable difficulties in practice. It is practically impossible to overcome these difficulties, if such a claw coupling is to be used not only for the HO track, with which considerable problems already arise, but also for the N track.

To eliminate these difficulties, it has already been proposed in an older application that the swivelling restoring spring be constructed as a points tongue, lying optionally with clearance against the claw and integrally molded with the anchoring bracket. This construction, which is structurally simpler than a torsion spring, also fails with couplings for the N track, since the dimensions then become so small that, allowing for the unavoidable clearance and the manufacturing fluctuations, a reliably functioning coupling can no longer be realized with such restoring springs.

It is therefore an object of the invention to provide a claw coupling of the initially named type, which assures the couplings to be coupled and held reliably in the coupled position even without a restoring spring.

To accomplish this objective, provisions have been made in accordance with the invention that the support borehole and the support pin are each disposed at the outer edge of the anchoring bracket or the claw and that the anchoring bracket has an approach mandrel for the inner arm of the claw of the corresponding opposite coupling part. In this connection, the statement, "at the outer edge of the anchoring bracket" is understood to be a displacement to the outside of the supporting borehole and of the supporting pin relative to the longitudinal center line of the carriages and thus also of the couplings so that, taking into consideration the arrangement of the approach mandrel relative to the center line, the corresponding approach mandrel of the opposite coupling part finds an inner arm of the claw, against which it can push in order to press the claw inwards into the coupling position.

Due to the inventive displacement of the fulcrum towards the outside in conjunction with the approach mandrels, the claw, as two carriages come together, is always turned inwards and—due to the appropriate construction of the length of the approach mandrel—held in this inwardly turned position of the coupling. For this purpose, the dimensions of the approach mandrel are such, that it prevents the respective opposite claw from swivelling open towards the outside into an uncoupling position. The uncoupling can then take place only—as is after all desired—over an uncoupling rail and by lifting the claw.

When a coupling is subjected to normal tension when the train is being operated, there is automatic interlocking of the claws in the rigid hooks of the respective anchoring bracket, so that the inadvertent opening of the coupling need not be feared even when the coupling is subjected to jarring jolts. After all, the claws could be swivelled open towards the outside into the release position by such vibrations only if, at the same time, the carriages move apart by a certain distance $\Delta S$, as otherwise the approach mandrel lying against the inner arm of the opposite claw would prevent the claw swivelling open in this manner. This combination of the carriages moving apart at the very moment at which the claws are swivelled to the outside by jolts is, however, so exceptionally infrequent an occurrence, that such an accidental uncoupling also need hardly be feared. In addition, due to the appropriately tight tolerances of the length of the approach mandrel relative to the length of the outer arms of the claws and in conjunction with an undercut of the rigid hooks, such swivelling-open motions can be made even more difficult. One thus has, as it were, a type of kinematic locking system, in which, during the coupling operation, the heavy masses of the carriages move towards one another, while the claws, which practically have no mass compared to the carriages, can swivel inwards without any difficulties over the approach mandrels. For the reverse process, the inadvertent "jarring open" of the coupling, the very opposite relationships would have to exist, that is, the claw, with its tiny mass, would have to be able to push the opposite carriage away during a jarring motion or the coincidental, appropriate movement of the carriages, described above, would have to take place.

In order to exclude also the improbable case described above, according to which the claws swivel to the outside due to jarring motions while at the same time the carriages move apart by a distance $\Delta S$, so that each approach mandrel releases the inner arm of the opposite claw, provisions may be made pursuant to a refinement of the invention so that the approach mandrel, preferably integrally molded with the anchoring bracket, is constructed so as to be elastic in the axial direction. This can readily be achieved by appropriately shaping the plastic material and there are no difficulties even if the part is constructed from a harder plastic. The axial spring excursions, which are required to ensure that the mandrel always lies against the inner arm of the opposite claw and thus reliably prevents any automatic swivelling opening of the jaws due to jarring while the train is running, are so small, that the elasticity of the material need not be exceptionally high for this purpose.

In order to be able to carry out the pre-uncoupling operation, which was already addressed at the beginning, in spite of the absence of a restoring spring, provisions are made in a refinement of the invention to construct the anchoring bracket so that, when the supporting pin is raised, the claw is swivelled inwardly and deposited on the opposite anchoring bracket.

In accordance with a further characteristic of the present invention, this can be accomplished in a particularly simple manner by disposing a swivel bolt with a stop bevel, which passes through an elongated hole of the anchoring bracket, at the inner arm of the claw, said stop bevel pushing against the edge of the elongated hole when the claw is raised over an uncoupling rail and thus forcing the claw to swivel towards the inside.

Further advantages, characteristics and details of the invention arise out of the following description of an example of the operation and are illustrated by the drawing.

DESCRIPTION OF THE PREFERRED EMBODIMENTS

Figure 1:
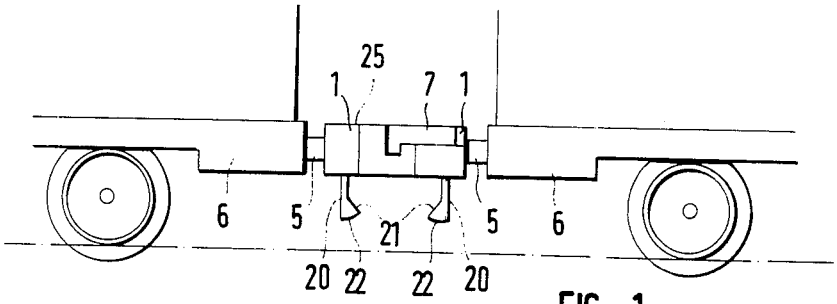
FIG. 1 is a partial elevational view of two model train carriages which are connected to one another by means of the inventive claw couplings.

Each coupling head comprises an anchoring bracket 1 with a rigid, outwardly pointing hook 2 at the front end and a plug-in connecting section 5 for insertion in mounting shafts 6, which are standardized, for example, in accordance with the European Model Train Standards NEM 362. On the anchoring bracket 1, a claw 7 is disposed, which engages with its support pin 8, disposed on the outside in the offset region between the hook section *7a* and the inner leg *7b*, a borehole of the anchoring bracket 1 and which comprises a hook head 10.

Figure 4:
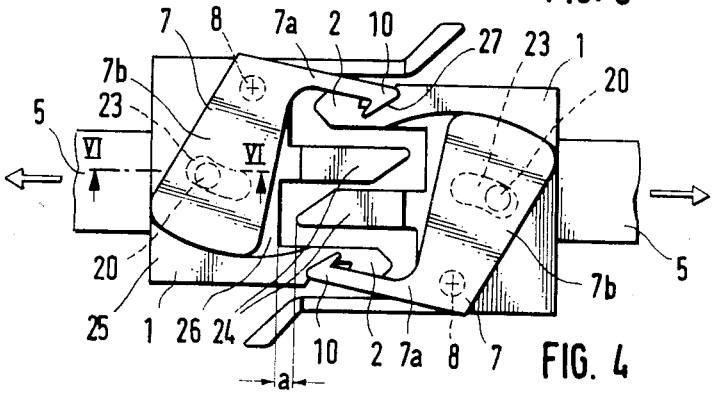
FIG. 4 is a plan view of two coupling heads in the pre-uncoupling position.
Figure 5:
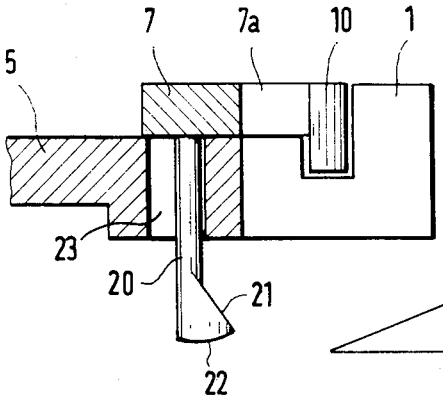
FIG. 5 is a sectional view taken along the line V—V of FIG. 3.
Figure 6:
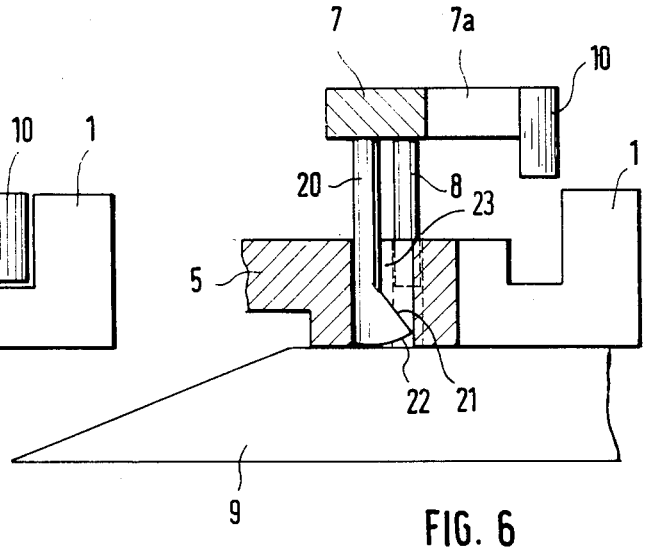
FIG. 6 is a sectional view taken along the line VI—VI of FIG. 4.

At the inner leg *7b* of the claw 7, a swivel bolt 20 is integrally molded, which is provided at the lower end with a thickening 22, which forms a stop bevel 21. This swivel bolt passes through an elongated hole 23 of the anchoring bracket. The stop bevel 21 is constructed so that, as the claw 7 is raised over an uncoupling rail 9, during which process (in contrast to the previously known Fox couplings, the swivel bolt 20 rather than the support pin forms the uncoupling bolt), the stop bevel 21 in conjunction with the elongated hole edges 23 compulsorily bring about a swivelling of the claw 7 towards the inside into the preuncoupling position shown in FIG. 4. After the carriage has passed over the uncoupling rail 9, the claw falls downwards into this inwardly swung position and rests on the respective opposite anchoring bracket 1, so that recoupling is possible once again only after the carriages have moved away from one another, so that the claw 7 can fall once again into the normal lower position. In this connection, the only vertical restoring force is gravity. During preuncoupled pushing, the approach mandrel 24 must press against leg *7b*, so that the whole claw is pressed inwards and thus the hook ends 10 also remain engaged on the hooks 2 of the opposite coupling. This can be achieved, for example, owing to the fact that the approach mandrels 24 are constructed higher than the surface 25 of the coupling parts, so that in the pushing position, in which the coupling parts are pushed together more than in FIG. 4, the approach mandrels also still lie in the raised plane of part *7b* of the claw. During a possible swivelling motion of the claw towards the outside, part *7b* would then immediately push against the pulled-up approach mandrel 24 and thus prevent any swivelling to the outside. In this connection, what matters is not only the height of the approach mandrels, which, after all, must still be present and effective in the raised position of the claws, but also the length, that is, the extent to which the couplings can be pushed together in the pushing position relative to the position in FIG. 4. In the example of the operation shown, this would be the distance "a" in FIG. 4. To enlarge this distance, the anchoring bracket could, for example, be provided with a recess in the region 26, so that the coupling parts could approach one another even more closely, thus providing even fewer possibilities for the claws to swivel open.

For the mode of functioning of the inventive claw couplings, the stop bevels 27 at the hook heads 10 and the counter-stop-bevels 28 at the rigid hook ends are also required. They namely ensure that the hook ends 10 are guided reliably during the coupling process over the hooks 2, even if they should swivel inwards somewhat initially. Only when they have been swivelled open so far and the hook ends have arrived at a position immediately behind the hooks 2, may the approach mandrels 24 exert their effect.

Finally, the approach mandrels 24 should also be so disposed that, closely adjacent side by side, they safeguard the coupling against shear motions. Such lateral displacements of the couplings relative to one another would otherwise have to be absorbed by the hook heads 10 of the claws which, in so doing, could break off.

Figure 2:
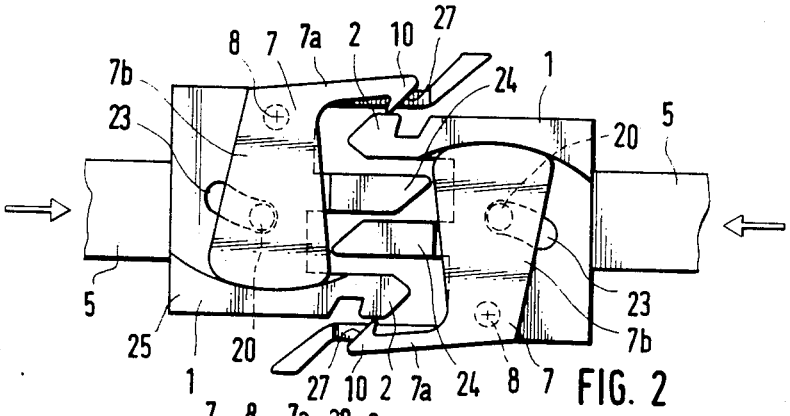
FIG. 2 is an enlarged plan view of the two coupling heads during the coupling process as the carriages approach one another.
Figure 3:
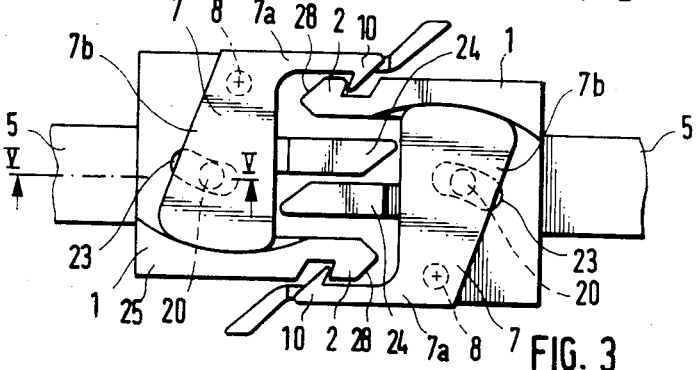
FIG. 3 is a plan view corresponding to FIG. 2 in the coupling position.

As two coupling heads come together (see especially FIGS. 2 and 3) the inner arm *7b* of each claw pushes against an approach mandrel 24 of the respective opposite anchoring bracket, the length of which is dimensioned so that it prevents any automatic (for example, due to the effects of jarring) swivelling motion of the claws 7 towards the outside into the open uncoupling position. Uncoupling is thus possible only by raising the claws 7 relative to the hooks 2. Moreover, the construction can be such that the approach mandrels 24 have a slight axially elastic compressibility, which can be achieved, for example, by the indicated tip, so that the approach mandrel constantly is in elastic contact with the inner leg *7b* of the opposing claw 7 and thus prevents the coupling being "jarred loose" even during a jarring trip.

I claim:

1. A claw coupling for toy model trains for coupling and uncoupling to a like claw coupling, comprising an anchoring bracket having hook means, claw means pivotably mounted on the anchoring bracket and having a pivoted coupling position in which the claw means engages and couples the hook means of another like claw coupling, said claw means having a support pin with a vertical axis, said anchoring bracket having a hole means in which said support pin is received, said support pin being engageable by an uncoupling rail to raise said support pin in said hole means to effect uncoupling of said claw means from the hook means of another like coupling, said anchoring bracket having a mandrel means juxtaposed to the claw means of another like coupled claw coupling to preclude the last said claw means from pivoting from its pivoted coupling position, whereby the mandrel means retains the claw means of said other like claw coupling in said pivotal coupling position.

2. A claw coupling according to claim 1 wherein said claw means comprises a lever having two leg portions, one of said leg portions having a claw part which engages and couples the hook means of another like claw coupling, the other of said leg portions being engageable by the mandrel means of another like claw coupling to prevent said lever from pivoting from said pivotal coupling position.

3. A claw coupling according to claim 2 wherein said support pin extends from said other leg portion, said lever having a pivot pin at the juncture between said two leg portions.

4. A claw coupling according to claim 3 wherein, said hole means is spaced from said pivot pin.

5. A claw coupling according to claim 2 wherein said hook means and said claw part are each provided with a beveled portion.

6. A claw coupling according to claim 1 wherein said mandrel means comprise an elongated mandrel element which is axially elastic.

7. A claw coupling according to claim 1 wherein said support pin has swivel means thereon such that when said support pin is raised upon engaging said uncoupling rail, said swivel means engages said hole means to swivel said claw means from said pivotal coupling position to another pivotal position in which a portion of the claw means overlies the hook means of another like claw coupling.

8. A claw coupling according to claim 1 wherein said claw means has a lower surface which engages an upper surface of said anchor bracket when said claw means is in said pivotal coupled position, said support pin extending vertically downwardly from said lower surface of said claw means.

9. A claw coupling according to claim 1 wherein said support pin has a lower portion which extends beyond the lower longitudinal end of said hole means, and a thickened head on said lower portion.

10. A claw coupling for toy model trains for coupling and uncoupling to a like claw coupling, comprising an anchoring bracket having hook means, claw means pivotably mounted on the anchoring bracket and having a pivoted coupling position in which the claw means engages and couples the hook means of another like claw coupling, said anchoring bracket having a mandrel means juxtaposed to the claw means of another like coupled claw coupling to preclude the last said claw means from pivoting from its pivotal coupling position, whereby the mandrel means retains the claw means of said other claw coupling in said pivotal coupling position, said anchoring bracket having a base portion, said hook means comprising a hook element projectioning from one side of said base portion, said mandrel means comprising a mandrel element projecting from said one side of said base portion, said hook element and said mandrel element being spaced from one another and parallel to one another, said space between said mandrel element and said hook element receiving the mandrel element of another like claw coupling.

11. A claw coupling for toy model trains for coupling and uncoupling to a like claw coupling, comprising an anchoring bracket having hook means, claw means pivotably mounted on the anchoring bracket and having a pivoted coupling position in which the claw means engages and couples the hook means of another like claw coupling, said claw means comprising a lever having two leg portions, one of said leg portions having a claw part which engages and couples the hook means of another like claw coupling, said anchoring bracket having an elongated mandrel, the other of said leg portions of said lever being engageable by the mandrel of another like claw coupling to pivot the last said claw means to its pivoted coupling position as the two like claw couplings move towards one another upon being coupled, said mandrel being juxtaposed to said other leg portion of the lever of the claw means of another like coupled claw coupling to preclude the last said claw means from pivoting from its pivoted coupling position, whereby the mandrel retains the claw means of said other like claw coupling in said pivoted coupling position.

12. A claw coupling according to claim 11 wherein said anchoring bracket has a base portion, said hook means comprising a hook element projectioning from one side of said base portion, said mandrel comprising a mandrel element projecting from said one side of said base portion, said hook element and said mandrel element being spaced from one another and parallel to one another, said space between said mandrel element and said hook element receiving the mandrel element of another like claw coupling.

13. A claw coupling for toy model trains for coupling and uncoupling to a like claw coupling, comprising an anchoring bracket having hook means, claw means pivotably mounted on the anchoring bracket and having a pivoted coupling position in which the claw means engages and couples the hook means of another like claw coupling, said anchoring bracket having a mandrel means juxtaposed to the claw means of another like coupled claw coupling to preclude the last said claw means from pivoting from its pivotal coupling position, whereby the mandrel means retains the claw means of said other like claw coupling in said pivotal coupling position, and support means on said claw means operable to provide for raising said claw means relative to said anchoring bracket to effect uncoupling two like claw couplings.

14. A claw coupling according to claim 13 wherein said claw means comprises a lever having two leg portions, one of said leg portions having a claw part which engages and couples the hook means of another like claw coupling, the other of said leg portions being engageable by the mandrel means of another like claw coupling to prevent said lever from pivoting from its pivoted coupling position.

15. A claw coupling according to claim 14 wherein said lever has a pivot pin at the juncture between said two leg portions.

* * * * *